United States Patent [19]

Whitener, Jr.

[11] Patent Number: 4,570,312

[45] Date of Patent: Feb. 18, 1986

[54] METHOD AND APPARATUS FOR PRODUCING ENTANGLED YARN

[76] Inventor: Charles G. Whitener, Jr., P.O. Box 27578, Atlanta, Ga. 30327

[21] Appl. No.: 556,145

[22] Filed: Nov. 29, 1983

[51] Int. Cl.[4] ..... D02G 1/16; D02J 1/08

[52] U.S. Cl. ..... 28/271; 28/248; 28/274

[58] Field of Search ..... 28/271, 274, 275, 276, 28/248, 260

[56] References Cited

U.S. PATENT DOCUMENTS

| | | | |
|---|---|---|---|
| 2,158,547 | 5/1939 | Lawson et al. | 66/132 |
| 2,160,495 | 5/1939 | Francis | 242/45 |
| 3,093,330 | 6/1963 | Schmidt | 242/45 |
| 3,448,500 | 6/1969 | Benson | 28/271 |
| 3,448,670 | 1/1970 | Benson | 28/271 |
| 3,686,722 | 8/1972 | Li et al. | 28/260 |
| 3,710,460 | 1/1973 | Segraves | 28/271 |
| 3,874,156 | 4/1975 | Hamby | 28/260 X |
| 4,220,274 | 9/1980 | Schubert et al. | 242/47.08 X |
| 4,422,224 | 12/1983 | Gusack et al. | 28/274 X |

FOREIGN PATENT DOCUMENTS

| | | | |
|---|---|---|---|
| 1592657 | 6/1970 | France | 28/248 |
| 46-10502 | 3/1971 | Japan | 28/260 |
| 48-3864 | 2/1973 | Japan | 28/260 |

*Primary Examiner*—Robert R. Mackey

*Attorney, Agent, or Firm*—James B. Middleton

[57] ABSTRACT

A method and apparatus for producing air entangled yarn from a plurality of yarn ends. A group of individual yarn ends is gathered into a sliver, passed through a yarn tensioner, then wrapped around a pair of rotating rolls. The sliver is carried from the rolls into an air entangling head, and the entangled yarn is removed from the air entangling head and wrapped around the pair of rotating rolls. From the rolls, the entangled yarn is carried through a yarn tensioner and wound up into a standard package. Since the entangling of the individual yarns causes shortening of the sliver, tension is created in the sliver before the air entangling head, and this tension tightens the wrapping around the rotating rolls. The same tension is reflected in the entangled yarn leaving the air entangling head, and this tension tightens the wrapping of the entangled yarn around the rotating rolls. The rotating rolls are rotating at a greater surface speed than the linear speed of the sliver or the entangled yarn, so the tightening causes only a slightly greater feed. Since there is always slip, the amount of feed varies with the tension, so the rate of feed is self adjusting to produce the desired air entangled yarn.

5 Claims, 3 Drawing Figures

METHOD AND APPARATUS FOR PRODUCING ENTANGLED YARN

BACKGROUND OF THE INVENTION

Air entangled yarns have achieved great popularity, and there is abundant prior art concerned with improvements in air entangling of yarns. Most of the prior art relating to the air entangling of yarns is primarily concerned with the appropriate disposition of air jets and passages for yarn. While some attention has been directed towards the feeding of yarns to the air entangling head and the removal of the entangled yarn, such attention has been very slight, simply recognizing the necessity of providing sufficient yarn feed to allow the entangling, hence shortening, of the yarn, and to remove the entangled yarn from the air entangling head. While these are valid points, the resulting apparatus has taken the form of virtually positive feed rolls that are mechanically driven in order to provide the predetermined input rate and the predetermined output rate. One difficulty of this system is that the yarns, and the entangling thereof, are not necessarily uniform. As a result of the nonuniformity, some difficulty will be encountered in attempting to handle the yarns on a uniform basis. Furthermore, it will be understood that the yarns must be appropriately monitored, and appropriate portions of the apparatus varied in order to achieve a uniform entangled yarn.

SUMMARY OF THE INVENTION

This invention relates generally to the air entangling of yarns, and is more particularly concerned with a system for handling the yarns fed to the air entangling head and the removal of the entangled yarn.

The present invention provides a system wherein a plurality of yarn ends is fed to roll means, the yarn ends being placed in a loop around said roll means. The yarn ends then pass through an air entangling head; then, the entangled yarn passes around said roll means providing a second loop. The entangled yarn then passes through appropriate tensioning means and to a yarn package. Due to this arrangement, it will be understood that the shortening of the yarns due to the entangling will result in increased tension on the loops of yarns, and the increased tension will cause the roller means to drive the yarns more efficiently. The yarns slip with respect to the roll means at all times, so the changing of the rates of feed is automatically self adjusting. Monitoring means would be used to assure uniform quality primarily by pointing out defects in the system.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Referring now more particularly to the drawings, and to that embodiment of the invention here presented by way of illustration, it will first be undersrood by those skilled in the art that a generally conventional source of yarns will be provided. The source may be a generally conventional creel, one or more knit socks, or virtually any other source from which two or more ends can be fed.

Figure 1:
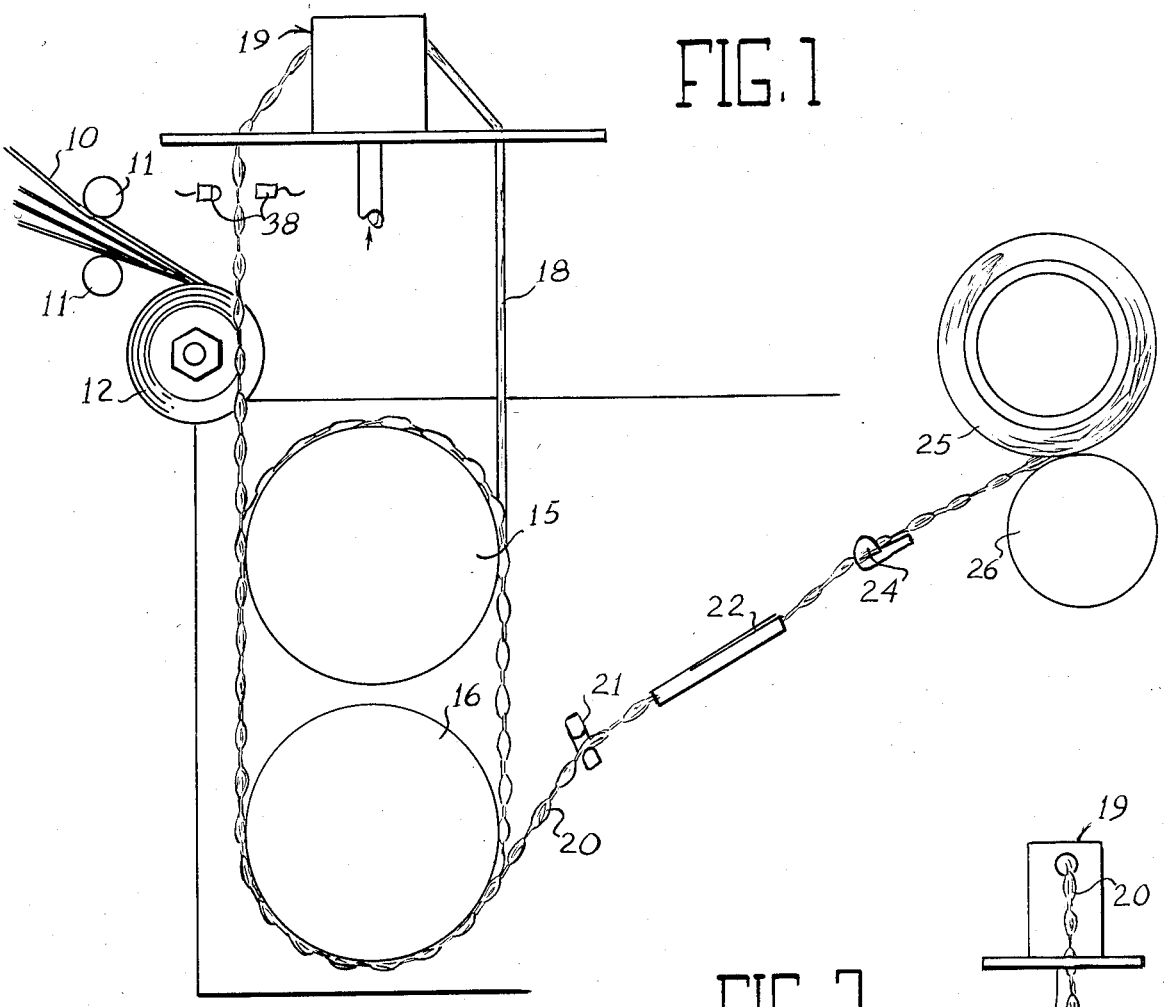
FIG. 1 is a somewhat schematic side elevational view showing apparatus embodying the present invention.

In FIG. 1 of the drawings, a plurality of yarn ends are indicated at 10, the yarns ends 10 indicating simply a source of yarns to be entangled. The yarns 10 pass through appropriate guide means indicated at 11, then to a tensioning means 12. The tensioning means 12 is here shown as a pair of disks, one disk being urged towards the other by spring means so that variation of spring tension will vary the tension on the yarns. Such a device is well known to those skilled in the art and no further description is thought to be necessary.

The yarns 10 pass through the tensioning means 12 and are gathered somewhat in a sliver form indicated at 14. This sliver 14 constitutes the bundle of yarns that will eventually be air entangled.

There is a pair of driven rolls designated at 15 and 16, both the rolls 15 and 16 being driven in a counterclockwise direction as viewed in FIG. 1 of the drawings. The surface of the two rolls 15 and 16 is generally of a hardened aluminum alloy or the like, and are slightly textured, but remain reasonably smooth.

Figure 2:
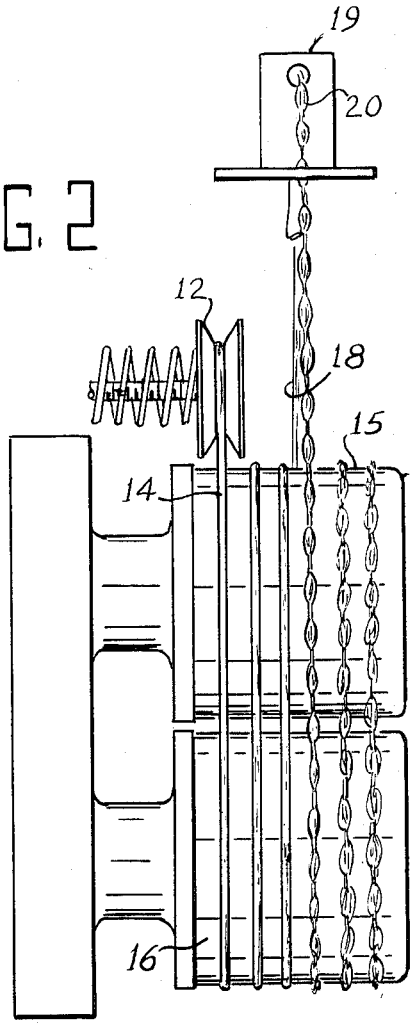
FIG. 2 is a front elevational view of the apparatus shown in FIG. 1; and, FIG. 3 is a block diagram illustrating the control system of the present invention.

With attention to both FIGS. 1 and 2 of the drawings, it will be understood that the sliver 14 passes from the yarn tensioning device 12 and around both the rolls 15 and 16, preferably a plurality of turns. In FIG. 2, it will be seen that the sliver forms three turns around the rolls 15 and 16. Following the third turn of the sliver 14, the sliver passes upwardly as indicated at 18, and passes through a yarn entangling head indicated at 19.

When the yarns emerge from the air entangling head 19, those skilled in the art will understand that the yarns have been entangled so that there is a plurality of bulked portions along the yarn, separated by areas in which the yarns are held together. The portions where the yarns are held together are frequently referred to as tacks. It will be understood that a good quality air entangled yarn will include substantially uniformly spaced bulked portions with substantially uniformly spaced tacks therebetween. Also, if an excess of yarn is fed to the air entangling head 19, the bulked portions will tend to be less neat, and less uniform, resulting in an unattractive yarn. If too little yarn is fed to the air entangling head 19, the resulting air entangled yarn will be excessively drawn so that the bulked areas and intermediate tacks are not apparent. In view of this, it will be understood that the appropriate feed rate to the air entangling head 19 is extremely important in order to obtain high quality air entangled yarns.

Looking especially at FIG. 2 of the drawings, it will be seen that, when the air entangled yarn 20 emerges from the air entangling head 19, the yarn 20 passes around the two rolls 15 and 16 a plurality of turns. Again, There are three turns here illustrated. Following the last turn, the entangled yarn 20 leaves the lower roll 16, passes through an appropriate guide 21, through a conventional tensioning means 22, then through a further yarn guide means 24 and to the yarn package 25. As shown in FIG. 1, it will be seen that there is a package drive roll designated at 26, the yarn package 25 bearing against the drive roll 26 for appropriate takeup of the yarn 20.

With the above discussed construction in mind, operation of the system should now be understandable. The yarn ends 10 will pass through the guide means 11 and through the tensioning means 12 to provide tension at the input side of the device. The drive roll 26 will drive a package 25, or a cone on which the package will be formed, this takeup system being through the tensioning means 22. This provides some tension on the output side of the system. With the rolls 15 and 16 operating at approximately 30% higher surface speed than the linear speed of the yarn 20, it will be understood that there is sufficient tension to cause the rolls 15 and 16 to provide some driving force for the yarns.

The sliver 18 entering the air entangling head 19 necessarily moves at a higher linear speed than the entangled yarn 20 emerging from the air entangling head 19 because the process of entangling necessarily shortens the yarns. With this arrangement, it will be understood that the continued driving of the yarn 20 creates a demand for the sliver, and causes tension in the sliver 18 immediately before entering the air entangling head 19. This increased tension will be reflected in a tightening of the loop of the sliver around the rolls 5 and 16. Also, as the yarn 20 emerging from the air entangling head 19 is slowed down because of increased tension in the sliver 18 entering the air entangling head, the loop of the yarn 20 around the rolls 15 and 16 will also be tightened around the rolls 15 and 16. Since both the input loop and the output loop are tightened around the rolls 15 and 16, it will be understood that the rolls will impart a greater driving force to both the sliver 18 and the yarn 20.

Again, it must be understood that the rolls 15 and 16 slip with respect to the yarns at all times, and the tightening of a loop around the rolls 15 and 16 simply decreases the slip to increase the yarn fed, but the tightening does not do away with the slip between the yarn and the rolls 15 and 16. Because of this arrangement, a slight tightening of the loop around the rolls 15 and 16 will cause an increased drive of the yarns, and this increased drive will continue only so long as the increased tension is present. Once the increased tension is relaxed, the loop around the rolls 15 and 16 will loosen and the drive will return to its previous state.

In view of the foregoing, it will be understood by those skilled in the art that the drive imparted by the rolls 15 and 16 will be directly proportional to the amount of yarn that needs to be fed to the air entangler 19. As more yarn is needed, there is greater driving of the yarn; and, when the amount of yarn is satisfied, the amount of yarn is not further increased. Further, the two rolls 15 and 16 may be provided in a Godet arrangement or the like so each strand will lie flat on the roll as shown.

It should now be understood that, as is seen in FIG. 2 of the drawings, the preferred system utilizes an equal number of turns of the incoming sliver and of the outgoing, entangled yarn. Since the rolls 15 and 16 slip with respect to the yarns at all times, the amount of drive will be proportional to the surface area of yarn in contact with the rolls 15 and 16. As a result, if more turns of one than the other are used, the drive will be uneven. In normal production, one will always use an equal number of turns of the sliver and the entangled yarn; however, one may use an unbalanced drive under some conditions, as when one wishes to remove some of the crimp in one or more of the yarn ends 10. By having a greater number of turns of the output, entangled yarn 20 than the input sliver 18, there will be greater tension on the output yarn 20, between the air entangling head 19 and the roll 15, and this increased tension will draw out some of the previous crimp in the yarns.

Figure 3:
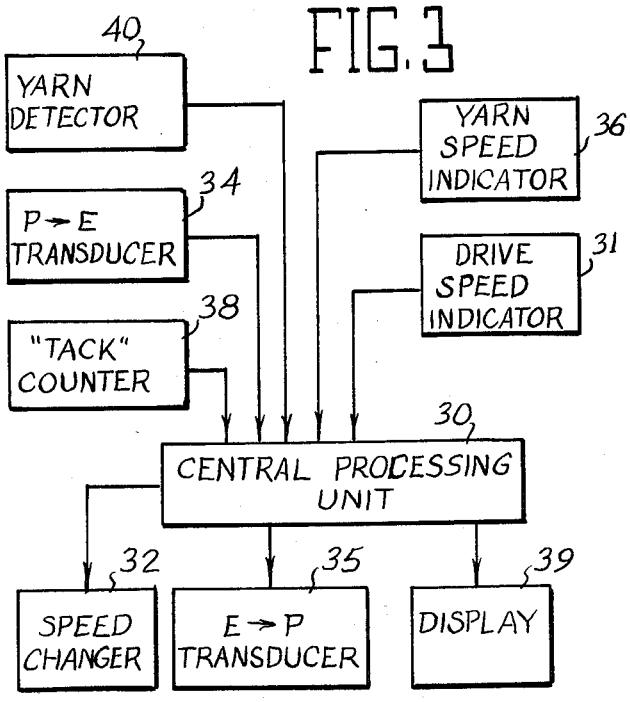

Attention is next directed to FIG. 3 of the drawings for a discussion of the operation of a system in accordance with the present invention.

It will first be recognized by those skilled in the art that, when an air entangling system is started up, the slow speed of the yarn due to start up in conjunction with the high pressure air, causes poor quality entangled yarn. In conventional systems, this poor quality yarn continues until the yarn speed is up to the desired maximum. To prevent the poor quality yarn, the air pressure would have to be reduced in accordance with the yarn speed; however, in conventional systems one would have to manipulate a manual valve or the like in order to increase the pressure gradually, and commensurately with the increased yarn speed.

In the system of the present invention, it will be seen that various information is fed to a central processing unit, and the central processing unit controls apparatus to maintain good quality yarn.

More specifically, looking at FIG. 3, the central processing unit is designated at 30, and there is a drive speed indicator 31. There is also a speed changer 32 which receives an output from the CPU 30. While those skilled in the art will devise many arrangements for accomplishing the intended function, it is contemplated that an alternating current motor will be utilized as the drive, and the alternating current motor will be supplied through an invertor having a variable frequency output to vary the speed of the synchronous, alternating current motor. With such an arrangement, those skilled in the art will realize that there will be an invertor reference voltage that is indicative of the speed of the drive, and this reference voltage can be fed to the CPU 30 and utilized in the calculations. As a result of the calculations, the speed changer designated at 32 would cause an appropriate frequency change to vary the speed of the synchronous motor.

Simultaneously, there is a transducer indicated at 34, the transducer converting air pressure to a voltage. The voltage will of course be an analogue of the air pressure, and this analogue signal can be readily converted to a digital signal for use by the CPU 30. The CPU 30 can then make the appropriate calculations, and the resulting signal can again be converted to an analogue voltage which will be fed to the transducer 35 to convert the analogue voltage to air pressure.

It will now be understood that the speed of the drive and the air pressure can be controlled relative to each other. A further piece of information is put into the CPU 30 by means of the yarn speed indicator 36. The yarn speed may be determined by any of numerous means, one relatively simple means being measurement of the rotational speed of the drive roll 26. Those skilled in the art will understand that the rotational speed can readily be converted to linear speed of yarn, and this information can be fed to the CPU 30.

With the above discussed information available to the CPU 30, the system of the present invention can be started up without producing unuseable yarn. The speed can be controlled so that the speed increases gradually. As the feed increases, the yarn speed will also increase gradually; and, as the yarn speed increases the air pressure will also be caused to increase. With such an arrangement, as the yarn speed is slow, the air pressure will be low so that high quality entangled yarn is produced from the beginning. As the speed increases, the air pressure increases, and the increases are maintained in proper proportion by the central processing unit 30.

A further check on quality of the yarn output of the present system includes tack counter 38. Looking again at FIG. 1 of the drawings, the tack counter 38 may take the form of a light source and receptor, also indicated at 38, in FIG. 1 of the drawings. A simple light source with a conventional photocell may be used as the receptor, or a phototransistor may be used. A phototransistor provides an excellent receptor because the transistor can be utilized directly in the control circuitry.

The output from the tack counter 38 is also fed to the central processing unit 30. Now, the CPU 30 includes the count of the tacks, which may be converted to tacks per inch, and the yarn speed indicator 36 provides the speed of the yarn. With these two pieces of information, it will by very easy to calculate the change in the number of tacks per unit length. This is important because, if the entangled yarn is too severely drawn, the number of tacks per inch will be reduced, thereby signaling a problem, designated as: Track Dropout Ratio. FIG. 3 includes a display indicated at 39 which may be a conventional cathode ray tube or the like, and this display can be used for displaying the number of tacks per unit length on a continuing basis. Also, of course, other variables can be displayed on the display 39 as desired in order to maintain adequate control over the system.

It will now be understood by those skilled in the art that the present invention provides a yarn handling system for air entangling means wherein the feed of the individual yarn ends, or the sliver, is precisely at the rate required to produce the air entangled yarn. When the speed is insufficient, the tension in the sliver will be increased to cause the loop around the rolls 15 and 16 to tighten and increase the drive of the sliver 18. The increase will be just sufficient to decrease the tension to the previous level and return the system to normal. Thus, the feed is at all times proper to produce the desired air entangled yarn, and the feed is at all times self adjusting to assure both proper infeed and proper outfeed. In conjunction with this drive arrangement, the control means assures proper startup without creating unuseable yarn. The monitoring means, largely in the form of the tack counter 38, allows constant monitoring of the quality of the output entangled yarn so changes can be made in air pressure, drive or the like to remedy any problems. As is common, a yarn detector 40 may be included by way of a stop motion means for shutdown in the event a yarn is broken or the like.

In one machine constructed in accordance with the present invention, production speeds in excess of 1100 meters per minute (over 1200 yards/minute) have been attained, yielding consistently high quality yarn. The prior art air entanglers can usually operate at only 450 meters per minute (500 yards/minute). The system of the present invention is thus a vast improvement.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. In a yarn entangling apparatus including an air entangling head for producing an entangled yarn having spaced tacks and bulky portions a yarn supply for supplying a plurality of yarn ends for forming a sliver, a sliver input for said air entangling head, an entangled yarn output from said air entangling head, an air supply for supplying air under pressure to said air entangling head, feed means for said sliver, and entangled yarn and take-up means for said entangled yarn, the combination therewith of a pair of rolls adjacent to said air entangling head, said pair of rolls having substantially uniform diameters along the axes thereof, plurality of loops of said sliver passing around both rolls of said pair of rotating rolls before feeding said sliver to said air entangling head a second plurality of loops of said entangled yarn passing around both rolls of said pair of rotating rolls before delivery of said entangled yarn to said take-up means said pair of rotating rolls being rotated at a greater surface speed than the feed rate of said sliver and delivery rate of said entangled yarn so that said pair of rolls slip with respect to said plurality of loops therearound whereby the feed and delivery rates are self-adjusting and uniformity of the entangled yarn is improved.

2. A yarn entangling apparatus as claimed in claim 1, and further including a tensioning means adjacent to said pair of rotating rolls, said tensioning means receiving said sliver between said yarn supply and said pair of rotating rolls.

3. A yarn entangling apparatus as claimed in claim 2, and wherein said take-up means comprises a yarn package for taking up said entangled yarn, and drive means for rotating said yarn package, said apparatus being further characterized by tensioning means between said pair of rotating rolls and said yarn package.

4. In a method for producing air entangled yarns having spaced tacks and bulky portions wherein a plurality of yarn ends is gathered as a sliver, said sliver is fed to an air entangling head, and an entangled yarn is removed therefrom and said entangled yarn is subsequently wound into a package, the improvement comprising the steps of passing said sliver a first plurality of turns around both rolls of a pair of constantly rotating rolls before feeding said sliver to said air entangling head, passing said entangled yarn a second plurality of turns around both rolls of said pair of constantly rotating rolls before winding said entangled yarn into a package, the diameter of said rolls being substantially uniform along their axes so that said first plurality of turns and said second plurality of turns are of substantially the same diameter, said second plurality of turns being equal in number to said first plurality of turns and spaced along the axes of said rolls from said first plurality of turns, said constantly rotating rolls rotating at a surface speed greater than the feed rate of said sliver and greater than the delivery rate of said entangled yarn, the arrangement being such that an increase in tension on the sliver will cause less slip between said sliver and said pair of rolls and hence faster feeding of the sliver towards the air entangling head, and an increase in tension on the entangled yarn will cause less slip between said entangled yarn and said pair of rolls and hence faster removal of the entangled yarn from the air entangling head whereby the feed and delivery rates are sefl-adjusting and uniformity of the entangled yarn is improved.

5. A method as claimed in claim 4, and further including the step of passing said sliver through a tensioning means before passing said sliver around said rotating rolls.

* * * * *